US005151033A

United States Patent [19]

Kawai et al.

[11] Patent Number: 5,151,033

[45] Date of Patent: Sep. 29, 1992

[54] ELECTRICAL CONNECTOR

[75] Inventors: Mitsuru Kawai; Masaru Yoshida; Yoshiro Sasaki, all of Tokyo, Japan

[73] Assignee: Hirose Electric Co., Ltd., Tokyo, Japan

[21] Appl. No.: 739,421

[22] Filed: Aug. 2, 1991

[30] Foreign Application Priority Data

Sep. 13, 1990 [JP] Japan ..... 2-241291

[51] Int. Cl.[5] ..... H01R 4/66

[52] U.S. Cl. ..... 439/95

[58] Field of Search ..... 439/95, 108, 609, 608, 439/620

[56] References Cited

U.S. PATENT DOCUMENTS 4,720,155 1/1988 Schildkraut et al. ..... 439/108

*Primary Examiner*—Eugene F. Desmond

*Attorney, Agent, or Firm*—Kanesaka & Takeuchi

[57] ABSTRACT

An electrical plug (1) includes a conductive shell (6) having an inner stopper shoulder (66); an insulation housing (7) placed within the conductive shell and having at least one terminal mounting aperture (22); at least one detachable terminal (8) mounted in the terminal mounting apertures; a detachable ground terminal (9) mounted in the terminal mounting aperture; a retention member (10) for retaining the detachable terminal and the detachable ground terminal; a conductive stopper ring (32) for cooperating with the inner stopper shoulder of the conductive shell to hold the insulation housing and the retention member within the conductive shell; a detachable ground member (23) attached to the ground terminal such that part of the ground member is brought into contact with the conductive stopper ring.

2 Claims, 8 Drawing Sheets

ELECTRICAL CONNECTOR

BACKGROUND OF THE INVENTION

1. Field of the Invention

The present invention relates to multiple pole electrical connector for use in electronic equipment or the like.

2. Description of the Prior Art

FIGS. 20 and 21 show a conventional electrical connector of this type. The electrical connector includes a connector block 53 which has a cylindrical shell 54 made from a metal, an insulation housing 55 made from an insulator, and four terminals 56 supported by the insulation housing 55. The cylindrical shell 54 is provided at the front end with a coupling section 57 which is to be inserted into the receiving shell of a mating receptacle. One of the terminals 56 is used as a ground terminal 56*a* which is provided with a grounding spring contact 59 with a screw 58. The front end of the grounding spring contact 59 is brought into contact with the inside wall 60 of the coupling section 57 for providing grounding.

In the conventional electrical connector, once the ground terminal 56*a* is determined, it is impossible to use the other terminals as ground terminals. However, the ground terminal varies with the customer. As a result, it has been necessary to make a variety of models to meet various customers' requirements, resulting in the increased unit manufacturing cost.

SUMMARY OF THE INVENTION

Accordingly, it is an object of the invention to provide a multiple pole electrical connector in which the ground terminal can be mounted in any terminal mounting aperture to meet a variety of applications, thus reducing the unit manufacturing cost.

According to the invention there is provided an electrical connector consisting of an electrical plug and an electrical receptacle. The electrical plug includes a conductive shell having an inner stopper flange; an insulation housing placed within the conductive shell and having at least one terminal mounting aperture; at least one detachable terminal mounted in the terminal mounting apertures; a detachable ground terminal mounted in the terminal mounting aperture; a retention member for retaining the detachable terminal and the detachable ground terminal; a conductive stopper ring for cooperating with the inner stopper flange to hold the insulation housing and the retention member within the conductive shell; a detachable ground member attached to the ground terminal such that part of the ground member is brought into contact with the conductive stopper ring.

Thus, the ground terminal with the ground member can be placed in any of the terminal apertures to meet a variety of applications, thereby reducing the unit manufacturing cost.

DESCRIPTION OF THE PREFERRED EMBODIMENT

Figure 1:
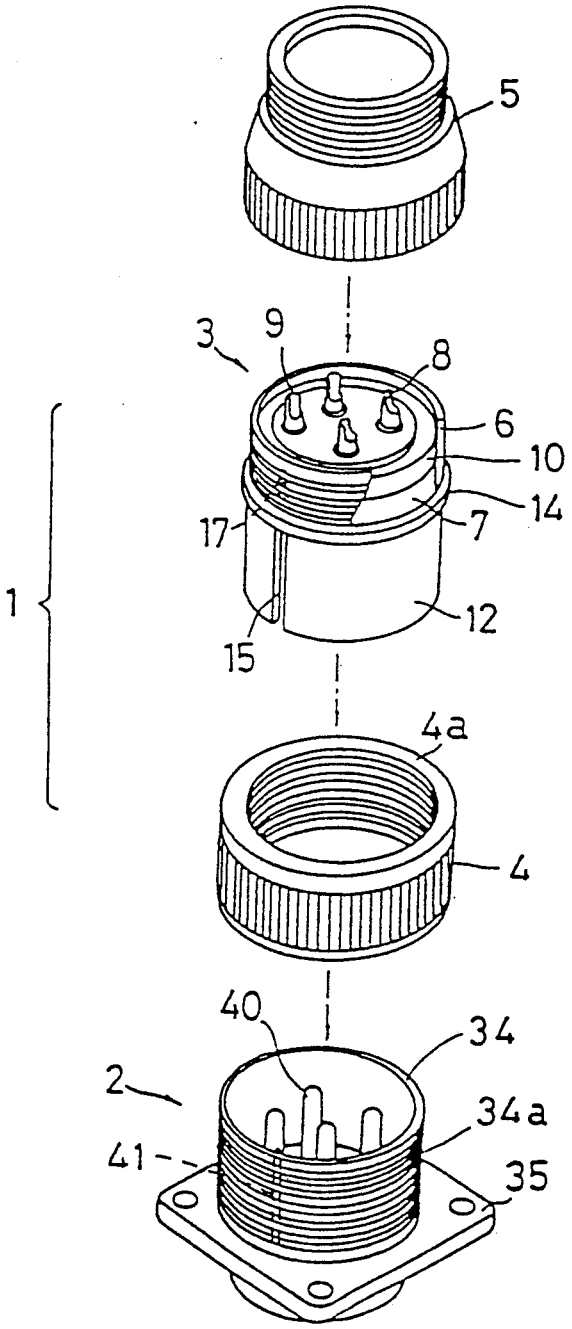
FIG. 1 is an exploded perspective view of an electrical connector consisting of a connector plug and a connector receptacle according to an embodiment of the invention.

In FIG. 1, a multiple pole electrical connector consists of an electrical plug 1 and an electrical receptacle 2. The electrical plug 1 includes a plug block 3, a coupling ring 4, and a cord ring 5. The plug block 3 includes a cylindrical shell 6 made from a metal; an insulation housing 7 placed within the cylindrical shell 6, and three female terminals 8 and one ground terminal 9 supported by the insulation housing 7.

Figure 2:
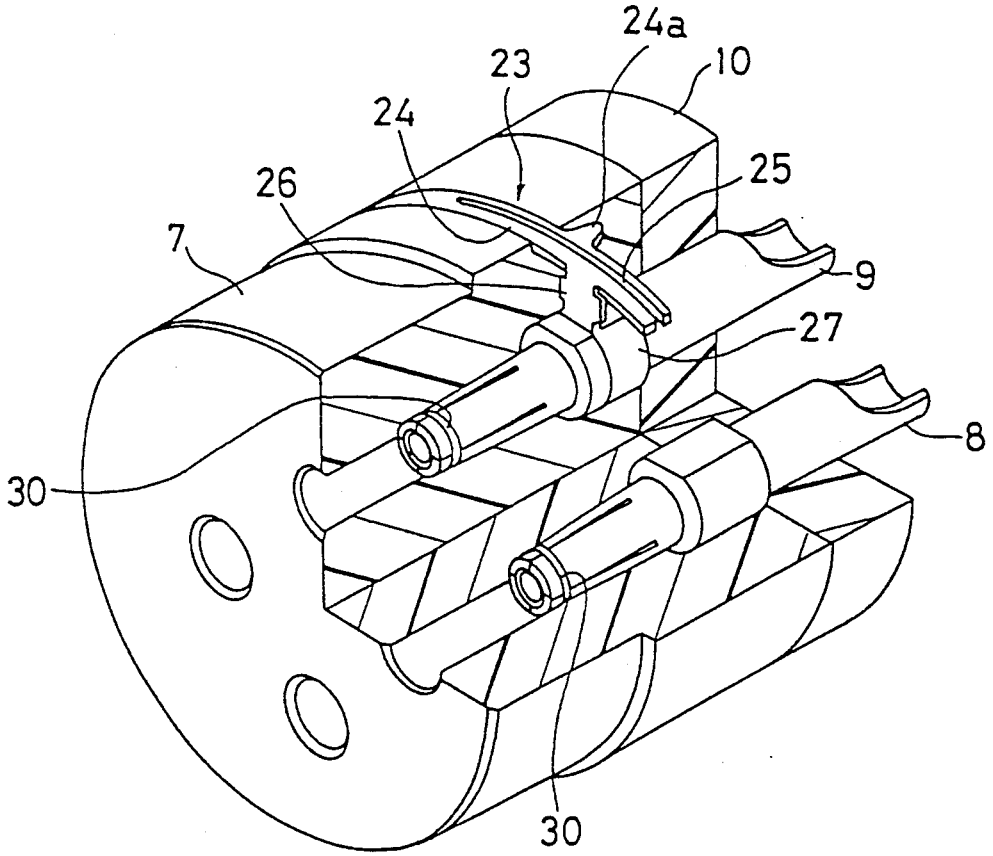
FIG. 2 is a partially cutaway perspective view of an insulation housing the connector plug.

In FIG. 2, the plug block 3 also includes a grounding member 23 affixed to the ground terminal 9, and a retention member 10.

Figure 3:
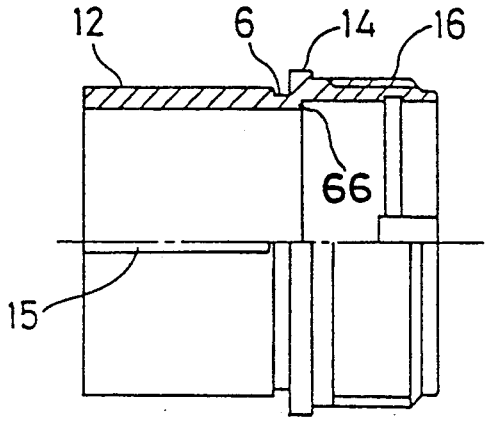
FIG. 3 a side elevational, partially sectional, view of a cylindric of the connector plug.
Figure 4:
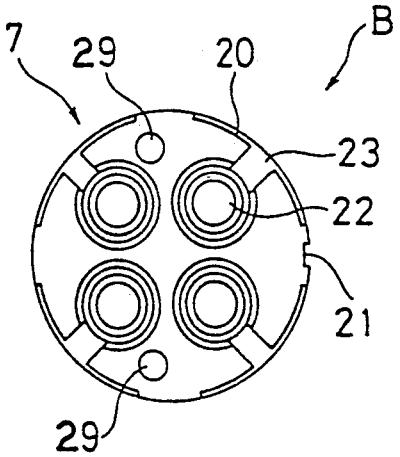
FIG. 4 rear elevational view of the insulation housing.
Figure 5:
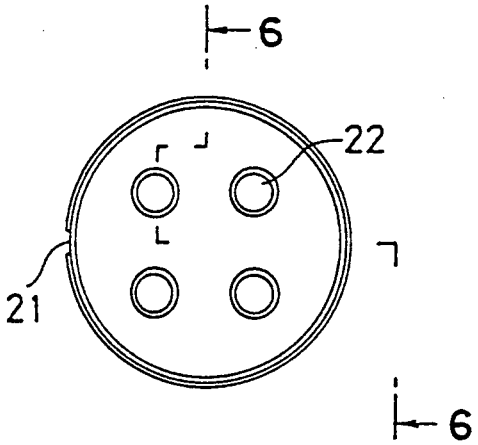
FIG. 5 a front elevational view of the insulation housing.
Figure 6:
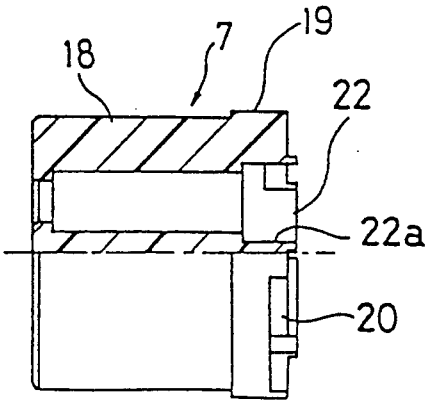
FIG. 6 is a partially sectional side view taken along line 6—6 of FIG. 5.
Figure 7:
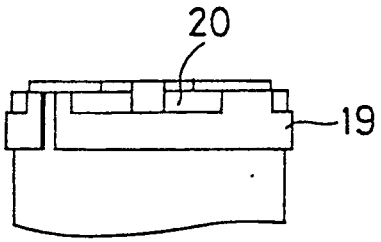
FIG. 7 is a side view of a rear portion of the insulation housing viewed from an arrow B of FIG. 4.
Figure 19:
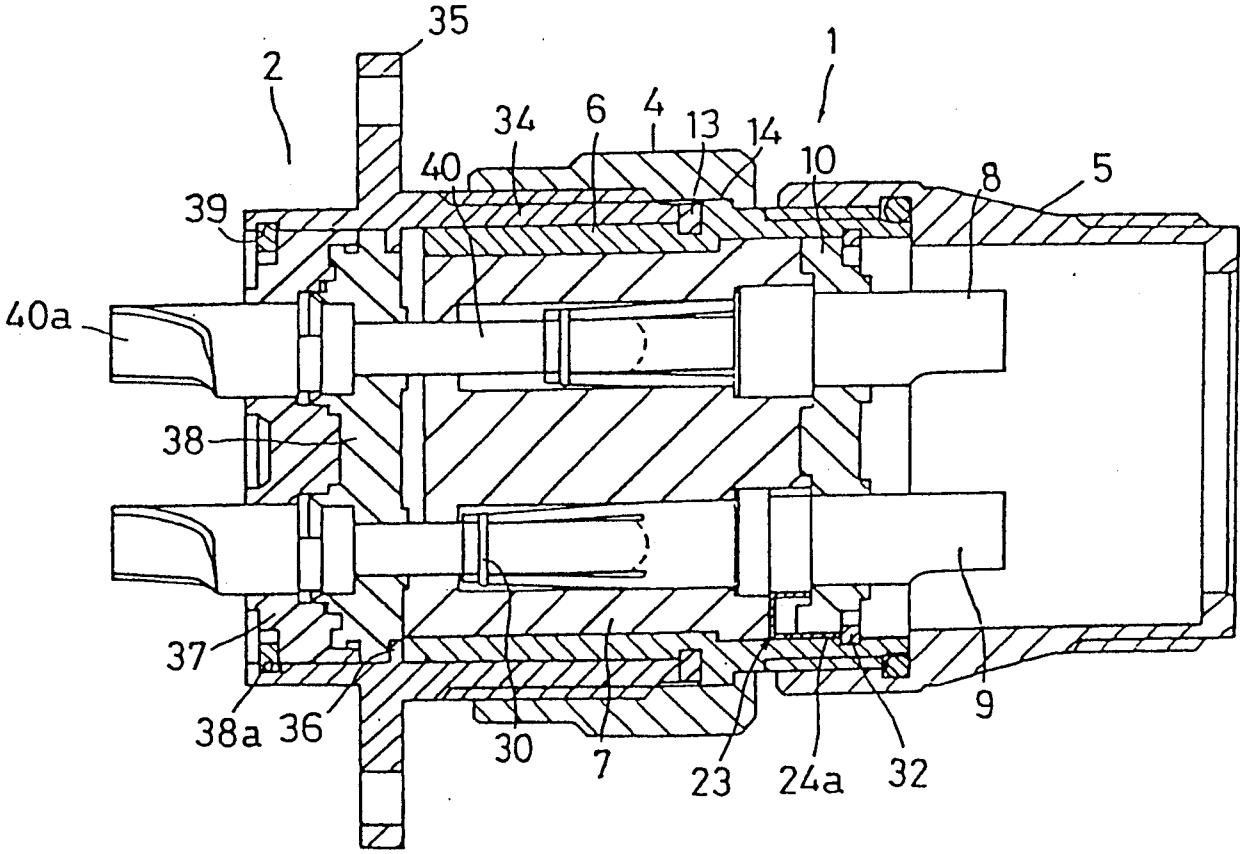
FIG. 19 is a longitudinal section of the connector plug and receptacle.
Figure 20:
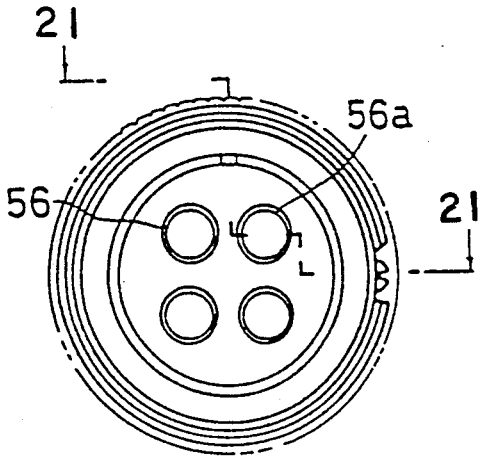
PRIOR ART FIG. 20
FIG. 20 is a front view of a conventional electrical connector.
Figure 21:
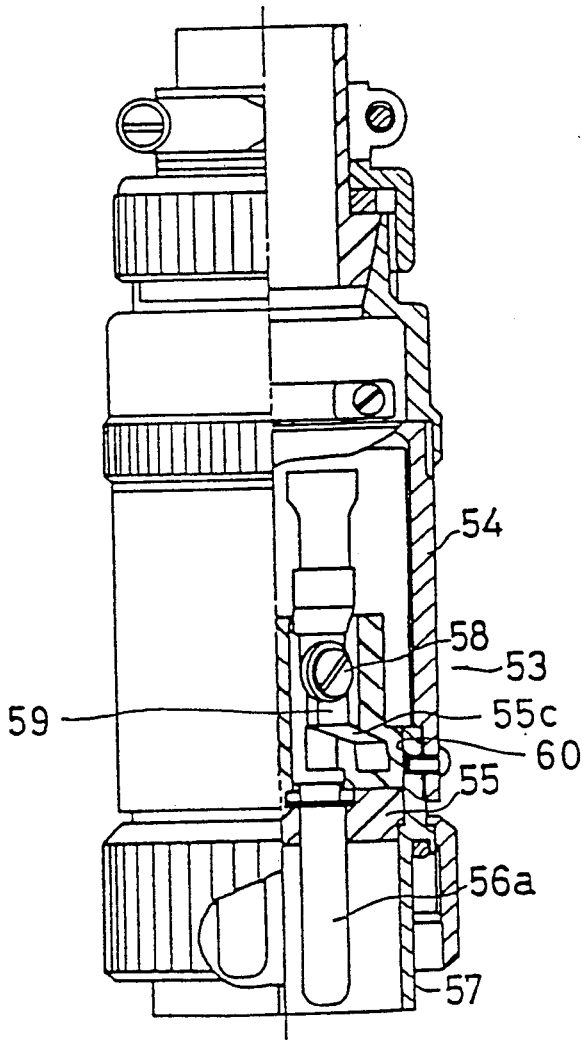
FIG. 21 PRIOR ART
FIG. 21 is a partially sectional side view taken along line 21—21 of FIG. 20.

In FIG. 3, the cylindrical shell 6 has a coupling section 12 in the front portion and an outer flange 14 in the middle portion for engaging the coupling ring 4 and a packing 13 (FIG. 19). Also, it has an inner stopper shoulder 66. The coupling section 12 has an axial slit 15 as a guide. The rear portion of the cylindrical shell 6 has an exterior thread 16 and an inner ridge 17 extending in the axial direction for serving as a guide.

In FIGS. 4–7, the insulation housing 7 has a cylindrical block 18 made from a synthetic resin. The cylindrical block 18 has an enlarged rear section 19, on the side wall of which four ground member mounting recesses 20 are formed at regular intervals and one guide channel 21 between two of the mounting recesses 20. Four terminal mounting apertures 22 are formed through the cylindrical block 18 on the lines each including the center of the grounding member mounting recess 20 and the center of the cylindrical block 18. Each terminal mounting aperture 22 has an enlarged rear portion 22*a*. Each ground member mounting recess 20 and each terminal mounting aperture 22 are linked with a channel 23. A couple of positioning holes 29 are formed on the rear face of the cylindrical block 18.

Figure 8:
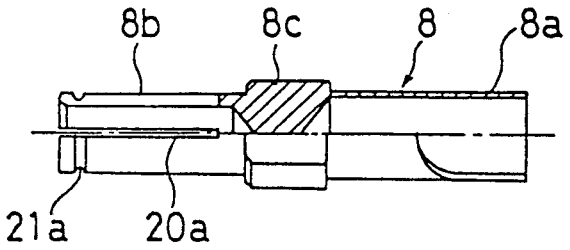
FIG. 8 a partially cutaway side elevational view of a female terminal.

In FIG. 8, the female terminal 8 has a cord connection portion 8*a*, terminal contact portion 8*b*, and an enlarged base portion 8*c* between them. The terminal contact portion 8*b* has an axial slit 20*a* and a circumferential channel 21*a* at the front portion.

Figure 9:
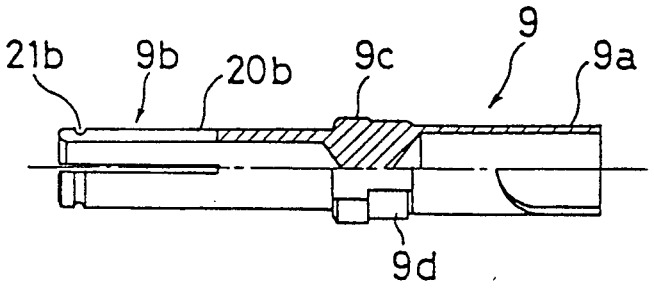
FIG. 9 is a partially cutaway side elevational view of a ground terminal.

In FIG. 9, the ground terminal 9 has a cord connection portion 9*a*, a terminal contact portion 9*b*, and an enlarged base portion 9*c* between them. The enlarged base portion 9*c* has a reduced ground member mounting portion 9*d*. The terminal contact portion 9*b* has an axial slit 20 and a circumferential channel 21*b* in the front portion.

Figure 10:
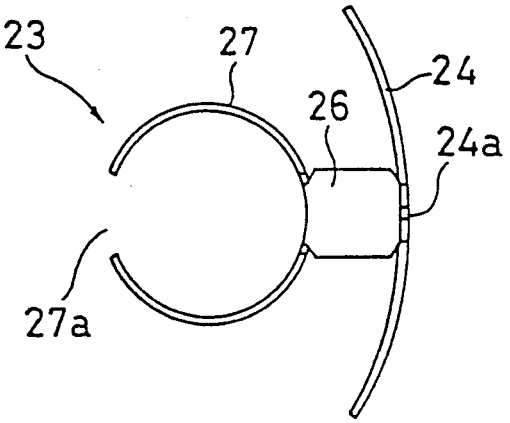
FIG. 10 is a top plan view of a ground member.
Figure 11:
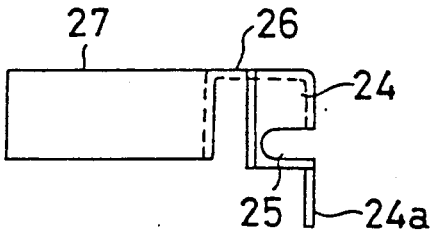
FIG. 11 is a side elevational view of the ground member.
Figure 12:
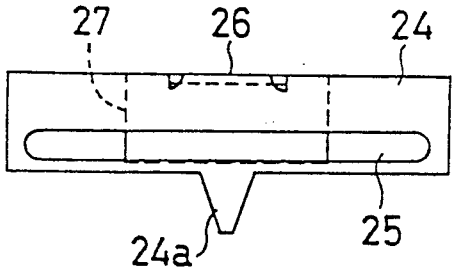
FIG. 12 is a front elevational view of the ground member.
Figure 13:
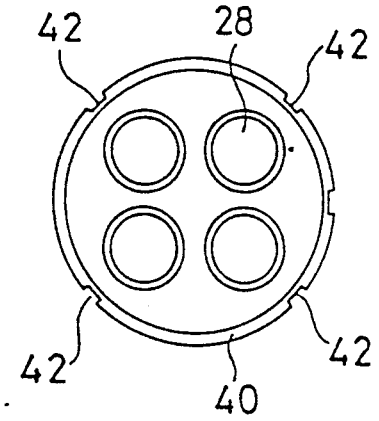
FIG. 13 is a rear elevational view of a retainer disk.
Figure 14:
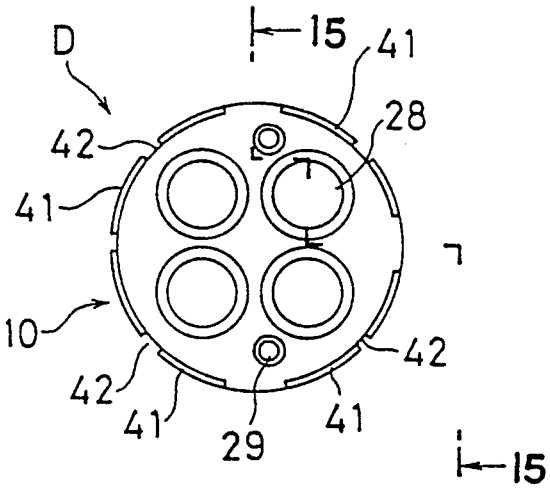
FIG. 14 is a front elevational view of the retainer disk.
Figure 15:
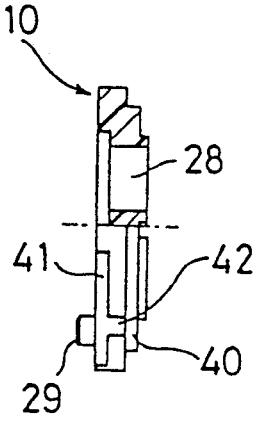
FIG. 15 is a partially sectional, side elevational view taken along line 15—15 of FIG. 14.
Figure 16:
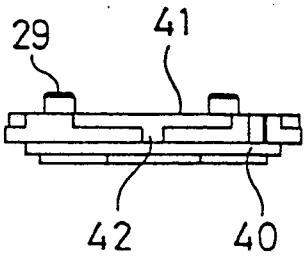
FIG. 16 is a side view of the retainer disk viewed from an arrow D of FIG. 14.

In FIGS. 10–12, the ground member 23 has a rectangular arc member 24 made from a sheet metal. The arc member 24 has a lengthwise slot 25 and a triangular projection 24*a* extending downwardly from the middle portion thereof. A circular mount strap 27 with an opening 27*a* is linked to the arc member 24 by a linkage piece 26.

In FIGS. 13–16, the retainer disk 10 is made from a synthetic resin and has four contact apertures 28 formed at equidistance from each other. A stop ring annular groove 40 and four ground member mounting recesses 41 are formed on the circumferential surface at regular intervals. Each ground member mounting recess 41 has a triangular projection receiving notch 42 in the middle portion thereof. A pair of positioning studs 29 extend forwardly from the retainer disk 10.

As best shown in FIG. 2, a spring ring 30 is put on each of the circumferential channels 21*a* and 21*b* of three female terminals 8 and one ground terminal 9, and the mounting strap 27 of the ground member 23 is fitted over the mounting portion 9*d* of the ground terminal 9. The three female terminals 8 and the ground terminal 9 are mounted in the terminal mounting apertures 22 such that the arc member 24 and the linkage piece 23 are fitted in the ground terminal mounting recess 20 and the channel 23, respectively.

Figure 17:
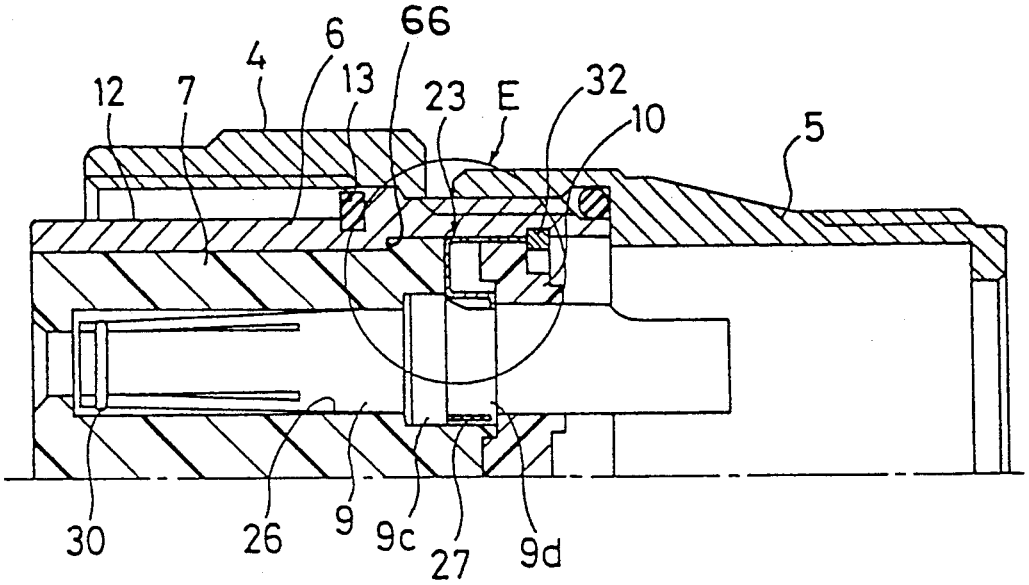
FIG. 17 is a sectional view of part of the connector plug.
Figure 18:
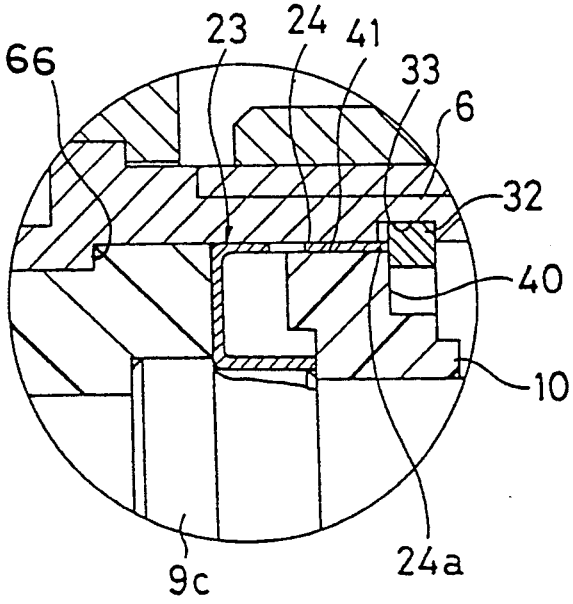
FIG. 18 is an enlarged view of a portion E of FIG. 17.

In FIGS. 17 and 18, the insulation housing 7 is put in the conductive shell 6 by sliding the guide ridge 17 of the conductive shell 6 along the guide channel 21 of the insulation housing 7 for positioning until the enlarged rear section 19 abuts the stopper shoulder 66 of the conductor shell 6. At this point, part of the arc member 24 of the ground member 23 is put in the ground member mounting recess 20. The retainer disk 10 is then fitted into the conductive shell 6 such that the female terminals 8 and the ground terminal 9 are put through the terminal through holes 28. A stopper ring 32 is then fitted in an annular space made by the annular groove 33 of the conductive shell 6 and the annular groove 40 of the retainer disk 10 to hold the insulation housing 7 and the retainer disk 10 in place. The arc member 24 of the ground member 23 is put in the ground member mounting recess 41 of the retainer disk 10 such that the triangular projection 24*a* is fitted in the receiving notch 42 and brought into contact with the stopper ring 32. Thus, the connector block 3 is completed.

The coupling ring 4 is mounted on the connector block 3 such that the inner flange 4*a* engages with the exterior flange 14 of the conductive shell 6 for rotation. The cord ring 5 is threaded over the conductive shell 6. Cords (not shown) are soldered to the cord connection portions 8*a* and 9*a* of the female terminals 8 and the ground terminal 9 to complete the plug 1.

Referring back to FIG. 1, the receptacle 2 has a cylindrical shell 34 and a square mounting flange 35 extending outwardly from the cylindrical shell 34.

In FIG. 19, an annular stopper flange 36 is formed on the inside of the cylindrical shell 34. A terminal support member 37 and a waterproof packing 38 are held one upon another within the receptacle shell 34 between the stopper flange 36 and the stopper ring 39 which is fitted in the annular channel 38*a* of the receptacle shell 34. Four male terminal 40 are mounted in the terminal support member 37 at equidistance from each other through the waterproof packing 38. Cords (not shown) are soldered to the cord connection portions 40*a* of the male terminal 40 of the completed receptacle 2. The receptacle 2 is affixed to an equipment panel, for example, by screwing the mounting flange 35.

The coupling section 12 of the conductive shell 6 is plugged into the receptacle shell 34 of the receptacle 2 such that the male terminals 40 are fitted into the female terminals 8 and the ground terminal 9 for electrical connections. The guide ridge 41 (FIG. 1) of the receptacle shell 34 is inserted into the guide channel 15 of the conductive shell 6 for guiding. Then, the coupling ring 4 is threaded over the receptacle shell 34 to connect the plug 1 to the receptacle 2. Consequently, the ground terminal 9 is grounded to the equipment panel via the ground member 23, the conductive shell 6, and the receptacle shell 34.

According to the invention, the ground terminal 9 can be mounted in a given terminal mounting aperture 22 of the insulation housing 7 such that the triangle projection 24*a* of the ground member 23 is brought into contact with the stopper ring 32. Thus, the ground terminal 9 and the ground member 23 can be mounted in any terminal mounting aperture 22 of the insulation housing 7 for the plug 1 so that a single model can meet various application requirements, thereby reducing the unit manufacturing cost.

We claim:

1. An electrical connector comprising:

a conductive shell having an inner stopper flange and an annular groove formed on an inside wall thereof;

an insulation housing placed within said conductive shell and having at least two terminal mounting apertures;

at least one detachable terminal mounted in one of said terminal mounting apertures;

a detachable ground terminal mounted in the other terminal mounting aperture;

a retention member for retaining said detachable terminal and said detachable ground terminal;

a conductive stopper ring set in said annular groove for cooperating with said inner stopper flange to hold said insulation housing and said retention member within said conductive shell; and a detachable ground member attached to said ground terminal such that part of said ground member is brought into contact with said conductive stopper ring.

2. The electrical connector of claim 1, wherein said retention member has a stop ring annular groove for cooperating with said annular groove of said conductive shell to form an annular space into which said stop ring is fitted.

* * * * *